US005870794A

United States Patent [19]

Harpell

[11] Patent Number: 5,870,794

[45] Date of Patent: Feb. 16, 1999

[54] BROOM

[76] Inventor: William Harpell, 2380 Findlay Road, Joyceville, Ontario, Canada, K0H 1Y0

[21] Appl. No.: 939,480

[22] Filed: Sep. 29, 1997

[51] Int. Cl.[6] ..... A47L 13/12

[52] U.S. Cl. ..... 15/105; 15/111; 7/166

[58] Field of Search ..... 15/105, 111; 7/166

[56] References Cited

U.S. PATENT DOCUMENTS

| | | | |
|---|---|---|---|
| 490,472 | 1/1893 | Clements | 15/111 |
| 600,956 | 3/1898 | Stutler | 15/111 |
| 722,017 | 3/1903 | Hayden | 15/111 |
| 774,689 | 11/1904 | McDermott | 15/111 |
| 950,012 | 2/1910 | Bender | 15/111 |
| 1,162,635 | 11/1915 | Miller | 15/111 |
| 1,438,371 | 12/1922 | Fletcher | 15/111 |
| 1,536,542 | 5/1925 | Wegner | 15/111 |
| 1,667,651 | 4/1928 | Brady | 15/111 |
| 2,290,178 | 7/1942 | Hayford | 15/111 |
| 2,817,863 | 12/1957 | Johns | 15/105 |
| 3,307,212 | 3/1967 | MacInnes | 15/111 |
| 5,309,654 | 5/1994 | Mathis | 15/111 |
| 5,373,600 | 12/1994 | Stojanovski | 15/111 |
| 5,459,897 | 10/1995 | Wurdack | 7/166 |

FOREIGN PATENT DOCUMENTS

| | | | |
|---|---|---|---|
| 425771 | 3/1935 | United Kingdom | 15/111 |

*Primary Examiner*—Randall E. Chin

[57] ABSTRACT

A broom having a broom head with a top surface and a bottom surface. A broom handle projects upwardly and rearwardly from the top surface of the broom head with the bristles extending downwardly from the bottom surface of the head. A tool for use in working on the surface being cleaned by the broom is mounted on the broom head in a position be used when the broom is inverted. The tool can comprise a scraping member or a nail receiving slot for use in pulling nails.

9 Claims, 5 Drawing Sheets

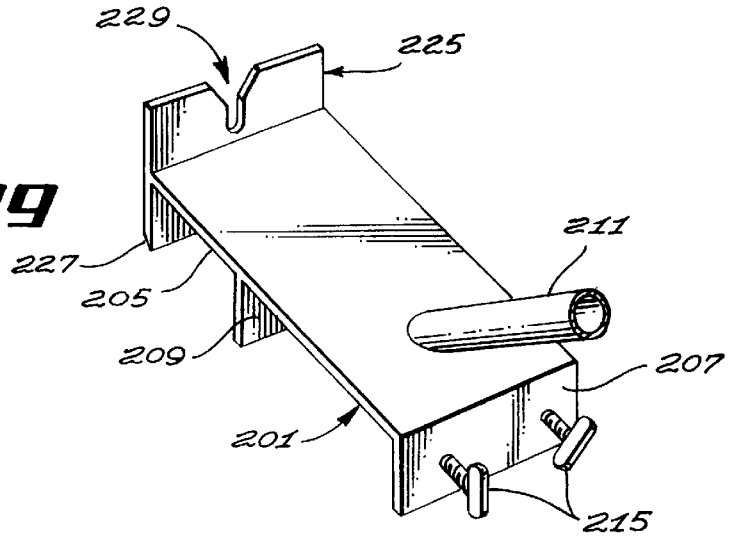
Fig. 19
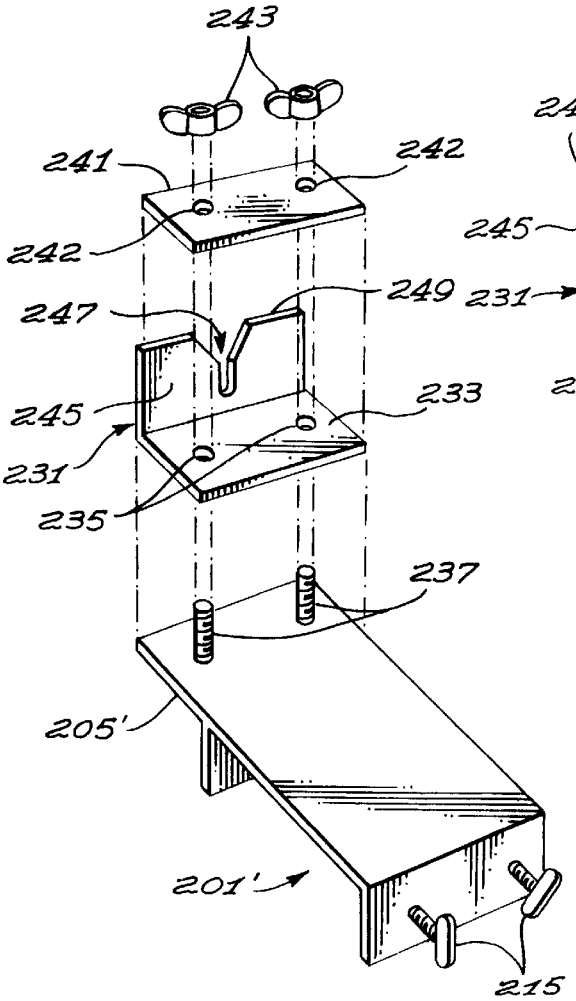
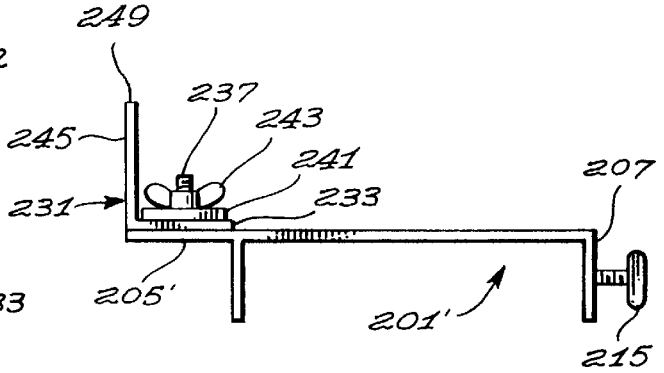
Fig. 21
Fig. 20

BROOM

BACKGROUND OF THE INVENTION

1. Field of the Invention

This invention is directed toward an improved broom. The invention is more particularly directed toward an improved broom for use on building and renovation projects. The invention is also directed toward an adapter for converting a broom to the improved broom.

2. Description of the Related Art Including Information Disclosed Under CFR §§ 1.97–1.99

Brooms, having a head with bristles projecting therefrom and a handle attached to the head, are often used on building or renovation projects to clean up the surface area where the work is taking place. However, the surface area being cleaned could have nails or adhered pieces of building material left in or on the surface. When a new shingle roof is being installed, for example, the broom is used to clean away the loose debris remaining on the roof after the old shingles have been removed. However, the sweeper often encounters roofing nails left sticking up from the roof after the shingles have been removed. The sweeper has to carry a hammer to remove these nails. Similarly, when replacing a tile floor, a broom is employed to sweep up the debris after the tiles have been removed. The sweeper often encounters pieces of tile that still are adhered to the floor however and requires a separate tool, such as a scraper, to remove them.

SUMMARY OF THE INVENTION

It is the purpose of the present invention to provide a broom having means thereon allowing the sweeper to use the broom not only to sweep up debris but also to remove nails or the like, or pieces of adhered building material, or both, to add to the debris. It is another purpose of the present invention to provide an adapter for converting a broom so that it can not only be used for sweeping but also for removing debris such as nails or adhered building material pieces.

In accordance with the present invention there is provided a broom having at least one tool mounted on the broom head for use in removing fixed debris from an area being cleaned, such as nails or adhered building material such as pieces of tile, when encountered by the broom during sweeping. The tool, in one embodiment, is on a tool plate attached to the broom head and projecting from the broom head. The free end of the tool plate carries a tool such as a nail receiving slot to receive the shank of a standard nail, such as a roofing nail or a small common nail. The slot is narrower than the head of the commonly encountered nails. When a partly embedded nail is encountered while sweeping, the broom is inverted to locate the shank of the nail in the slot on the tool plate on the head of the broom. The handle of the broom is then manipulated to easily lever the nail out of the surface and after adding the nail to the debris, the broom is reverted, and sweeping continued. Alternatively, the tool is on a tool plate in the form of a tapered free end of the tool plate. The tool plate is attached to the broom head and projects from the head to terminate in the straight, free end. This end is tapered for use in scraping adhered pieces of building material off the floor being swept. When adhered pieces of material are encountered during sweeping the broom is inverted to allow the tapered end of the tool plate to be driven under the material to loosen or separate it from the surface being swept. The tool plate can also carry two tools. In this embodiment, the tool plate has a tool section with two free ends and a tool on each free end. Both free ends are spaced from the broom head.

In accordance with another embodiment of the invention, there is provided an adapter for mounting on an existing broom head, the adapter carrying one or more tools and receiving the broom handle. The adapter can include means for detachably mounting it on a broom head.

The invention is particularly directed toward a broom having a broom head, the broom head having a top surface and a bottom surface. A broom handle projects upwardly and rearwardly from the top surface of the head. Bristles extend downwardly from the bottom surface of the head. A tool, for use in working on a surface being cleaned by the broom, is mounted on the head of the broom in a position be used when the broom is inverted.

The invention is also directed toward an adapter for use in mounting a tool on a broom, the adapter having a tool plate. Means are provided on the tool plate for use in mounting a base section of the tool plate on the top of the broom head. The base section carries a broom handle mounting member. The tool plate has a tool section adjacent the base section which carries a tool on its free end spaced from the broom head when the base section is mounted on the broom head. The tool is for use in working on the surface being cleaned by the broom. In one embodiment, the adapter has means for detachably mounting it on the broom.

BRIEF DESCRIPTION OF THE DRAWINGS

FIG. 19 is a perspective view of a modified adapter, similar to the adapter shown in FIG. 17;

FIG. 20 is a exploded view showing another embodiment of the adapter; and

FIG. 21 is a side view of the assembled adapter shown in FIG. 20.

DESCRIPTION OF THE PREFERRED EMBODIMENTS

Figure 1:
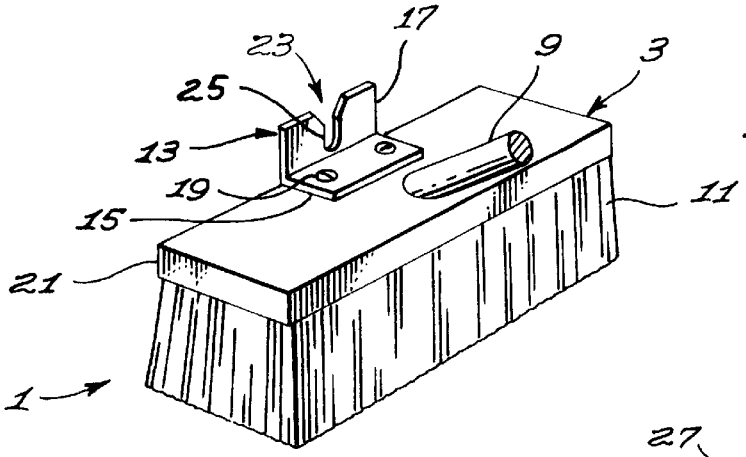
FIG. 1 is a perspective view of the improved broom.
Figure 3:
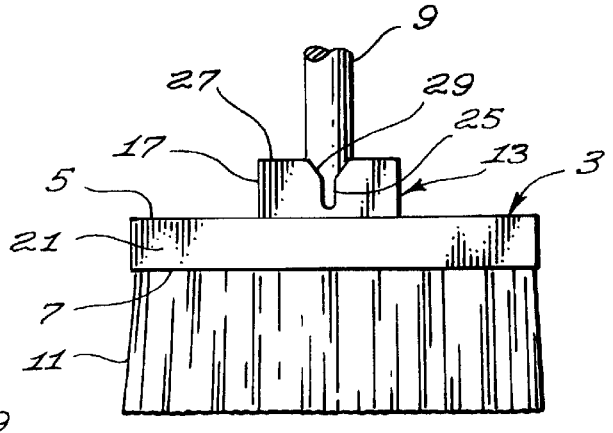
FIG. 3 is a front view of the improved broom.
Figure 2:
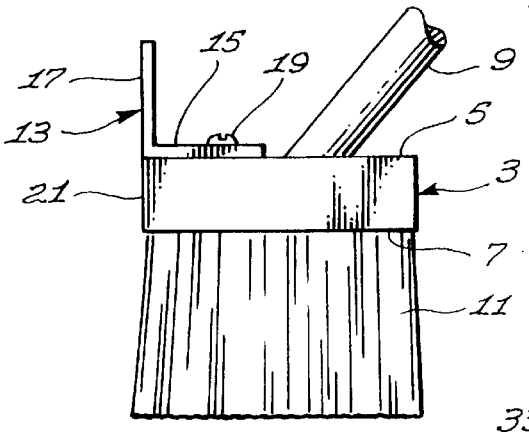
FIG. 2 is a side view of the improved broom.

The improved broom 1 of the present invention, as shown in FIGS. 1 to 3, has a broom head 3 with top and bottom parallel surfaces 5, 7. A broom handle 9 projects rearwardly and upwardly from the center rear of the top surface 5 of the head 3. The head 3 has bristles 11 extending downwardly from its bottom surface 7. A tool plate 13 is mounted on the top surface 5 of the broom head 3 in front of the handle 9. The tool plate 13 has a flat base section 15 and a tool section 17 that extends upwardly from one side of the base section 15 at an angle, preferably a right angle, thereto. The base section 15 is fastened flat, by suitable fasteners 19, to the top surface 13 of the broom head 3 with the tool section 17 extending in a direction opposite to the bristles 7. Preferably, the tool section 17 is aligned with the front face 21 of the broom head 3 but it can also be located in front of the front face.

The tool section 17 of the plate 13 has a tool 23 at its free end. The tool 23 is in the form of a slot 25 extending inwardly from the free end 27 of the tool section 17. The slot 25 has a wide mouth 29. The slot 25 is sized to receive the shank S of a nail N, shown in FIG. 4, but not to pass the head H of the nail N.

Figure 4:
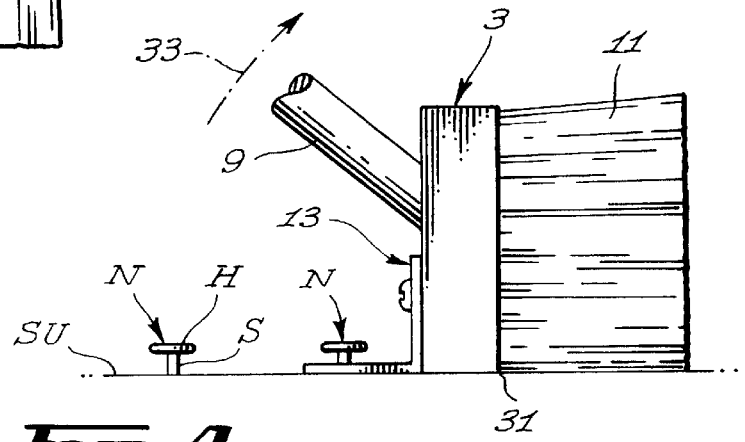
FIG. 4 is a side view showing the improved broom in use.

When a partly embedded nail N is encountered in a surface SU while sweeping it, the broom 1 is inverted, as shown in FIG. 4, and moved to slide the shank S of the nail N into the slot 25. The broom handle 9 is then levered upwardly, about the bottom, front edge 31 of the broom head 3 as shown by the arrow 33, to lift the nail N, via its head H, out of the surface. The broom is then flipped over again to continue sweeping debris including the removed nail.

Figure 5:
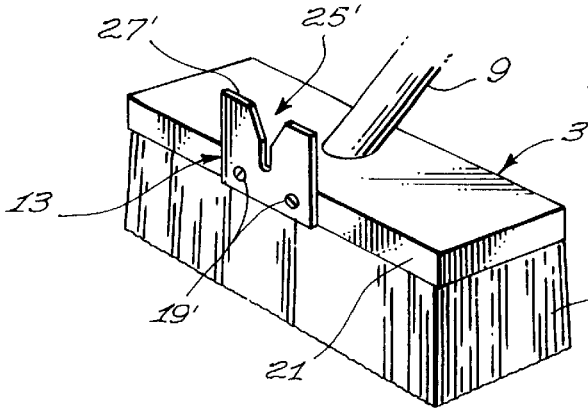
FIG. 5 is a similar to FIG. 1 showing another embodiment of a tool on a broom.

While the tool plate 13 has been shown as being angled, it could also be straight, as shown by tool plate 13' in FIG. 5 and be fastened, via its lower portion to the front face 21 of the broom head 3 by suitable fasteners 19'. The upper portion of the straight tool plate 13' has the slot 25' in its free end 27'.

Figure 6A:
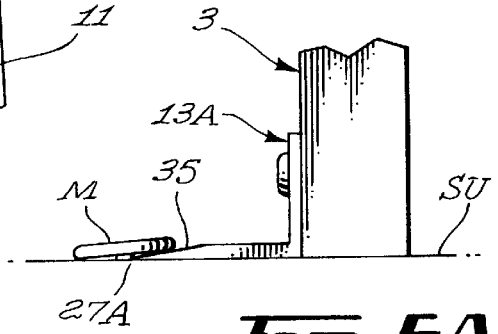
FIG. 6A is a detail side view showing another embodiment of a tool on a broom.

The tool plates 13, 13' have been shown as having tools in the form of slots 25, 25' for use in removing nails. The tool plates can, instead, be provided with tools in the form of a tapered free end for use in removing bits and pieces of material that adhere to the surface being swept. As shown in FIGS. 6A and 6B, the tool plates 13A, 13A' can have a free end 27A, 27A' that is tapered as shown at 35, 35' to provide a relatively sharp leading edge capable of partly sliding under material M, such as pieces of tile adhered on surface SU, as shown. Lifting of the handle 9 will lever the adhered material M loose.

The tool plates can combine a slot and a tapered, lifting edge if desired. The plates 13, 13' can, for example, have the free end 27, 27' on either side of the slot 25, 25' tapered (not shown). Thus the plates 13, 13' can be used to lift either nails or adhered debris.

Figure 6C:
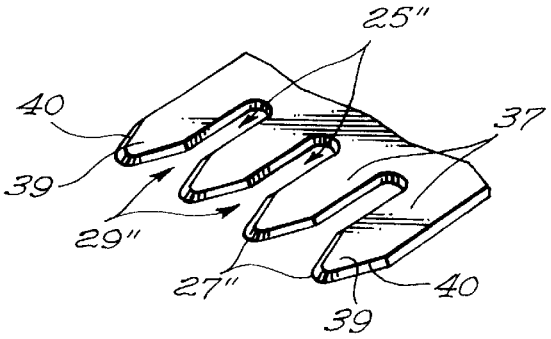
FIG. 6C is a detail perspective view of another embodiment of a tool on a broom.
Figure 6B:
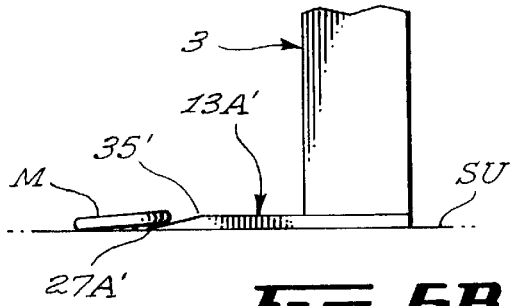
FIG. 6B is a detail side view showing a further embodiment of a tool on a broom.

In another variation, the plates 13, 13' could be provided with a series of slots 25" in the free end 27", the slots 25" forming parallel fingers 37 as shown in FIG. 6C. Each such slot 25" has a wide mouth 29" providing fingers 37 with tapered free ends 39. The free ends 39 can be rounded, and beveled on the sides and front as shown by 40. The plates 13, 13' could be used to both lift nails with anyone of the slots 25" and to lift adhered debris with the free ends 39 of the fingers 37. If desired, the slots 25" could be made in various widths to pull nails of various size.

Figure 7:
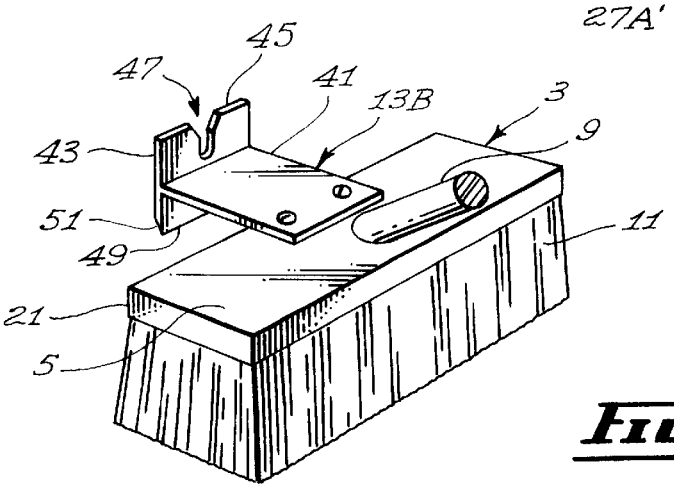
FIG. 7 is a perspective view showing yet another tool embodiment.

Alternatively, as shown in FIG. 7, the tool plate 13B can be formed in a T-shape having a base section 41 and a tool section 43 that crosses one end of the base section 41 to be transverse to it. The base section 41 is preferably rectangular in shape and is fastened to the top surface 5 of the broom head 3 as before but extends past the front face 21 of the broom head 3 to space the tool section 43, which is also preferably rectangular in shape, from the front face 21. The tool section 43 is parallel to the front face 21. One free end 45 of the tool section 43 has a nail slot 47 extending inwardly therefrom. The other, opposite, free end 49 of the tool section 43 is tapered as shown at 51. The broom with this tool plate 13B, after it is inverted, can be pulled toward, or pushed from, the sweeper to remove nails using the slot 47 or to loosen adhered debris with the tapered end 51. While the tool section 43 has been shown as being parallel to the front face 21 of the broom head 3 and transverse to the base section 41, the tool section 43 can be angled relative to the base section 41 so that the one free end 45 is closer to the broom head 3 than the other free end 49.

Figure 8:
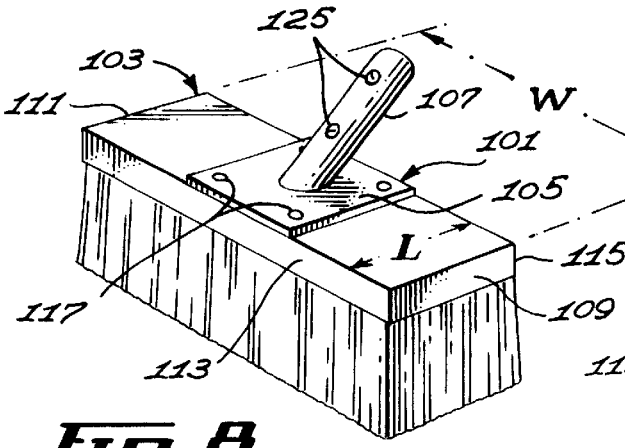
FIG. 8 is a perspective view of an adapter for use with a broom.
Figure 9:
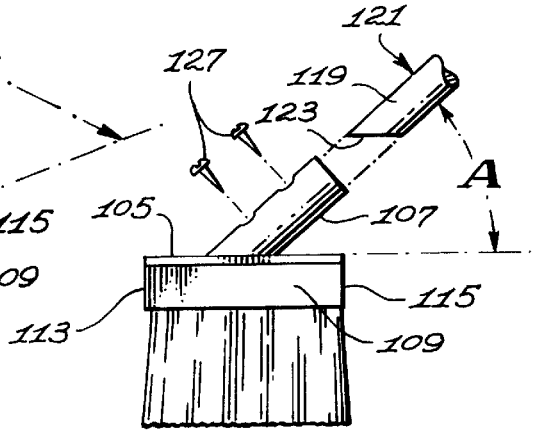
FIG. 9 is a side view showing the adapter mounted on a broom.

In another embodiment of the invention, an adapter 101 can be provided for detachably mounting on a broom head 103 as shown in FIGS. 8 and 9. The adapter 101, in the broadest sense, comprises a flat base section 105 with a tubular, handle-receiving, member 107 extending at an angle upwardly and rearwardly from the base section 105. The angle A is about forty five degrees but it can be up to ten degrees more or up to ten degrees less. The base section 105 is much narrower than the width W of the broom head between its ends 109, 111 but preferably has a length equal to the length L of the broom head between its sides 113, 115. The base section 105 is centered on the broom head 103 between its ends 109, 111 and detachably fastened thereto with fasteners 117. The tubular member 107 receives the lower end 119 of a broom handle 121. Preferably, the bottom 123 of the lower end 119 of the handle is cut at an angle so that the bottom 123 of the handle will fit flush on the base section 105 when placed in the tubular member 107. This ensures a strong connection between the handle and the broom. Holes 125 in the tubular member permit fasteners 127 to detachably connect the handle 121 to the tubular member 107.

Figure 10:
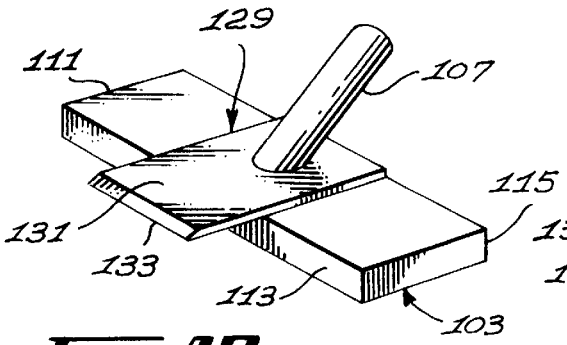
FIG. 10 is a perspective view showing an adapter with a scraping tool mounted on a broom.
Figure 11:
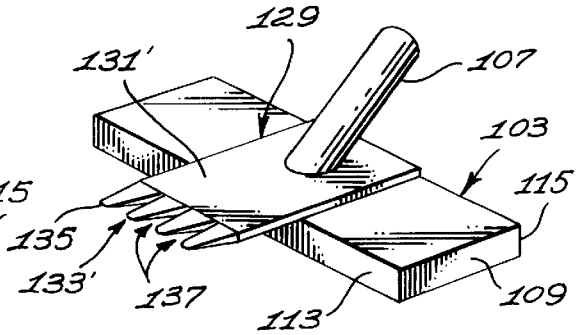
FIG. 11 is a perspective view showing an adapter with a scraping/nail pulling tool mounted on a broom.
Figure 12:
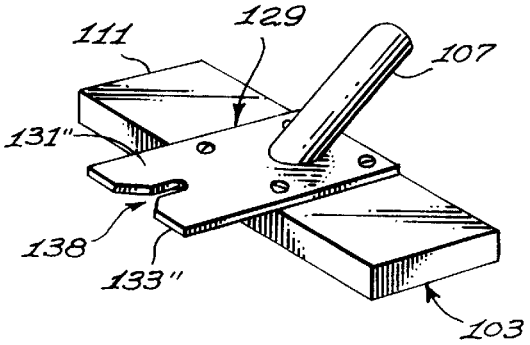
FIG. 12 is a perspective view showing an adapter with a nail pulling tool mounted on a broom.

The adapter 101 preferably adds at least one tool to the broom. To this end, as shown in FIG. 10, the adapter is formed into a tool plate 129 by adding an extension to the base section 105 which extension forms a tool section 131. The tool section 131 projects a short distance forwardly past the front side 113 of the broom head 103. The tool section 131 terminates in a straight, free end 133. This free end 133 is tapered to form a scraping edge that comprises the tool carried by the adapter. The broom can be turned over to use the tool to scrape material off the floor by pushing the broom forwardly. A nail receiving slot (not shown) can be provided in the free end 133 instead of having it tapered. The free end of the tool section 131 can also be modified to have a toothed free edge 133' as shown in FIG. 11, if desired, the teeth 135 being tapered toward the front and forming nail receiving slots 137 between them. This tool section can be used for both scraping and pulling nails. In still another alternative, as shown in FIG. 12, the straight free end 133" of the tool section 131" can have at least one nail receiving slot 138 and be untapered.

Figure 13:
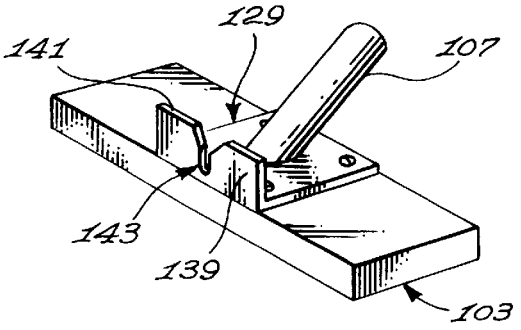
FIG. 13 is a perspective view showing an adapter with a different embodiment of a nail pulling tool mounted on a broom.

If desired, the tool plate 129 can have an extension forming a tool section 139 that extends upwardly at an angle, preferably a right angle, to the remainder of the plate as shown in FIG. 13. The free end 141 of tool section 139 can be straight and untapered with a nail receiving slot 143 as shown; straight and tapered with or without a nail receiving slot (not shown); or toothed (not shown) as before. With the embodiment shown in FIG. 13, the broom is turned over, positioned to receive a nail in the slot, and levered with the broom handle to lift the nail off the floor.

Figure 14:
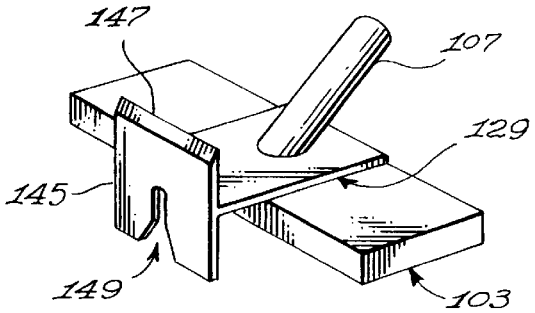
FIG. 14 is a perspective view showing an adapter with yet another version of a scraping/nail pulling tool mounted on a broom.
Figure 15:
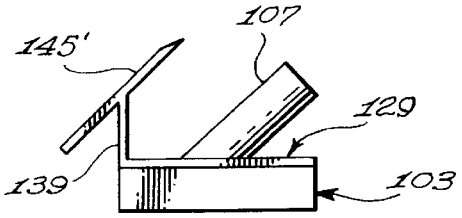
FIG. 15 is a side view of a modified version of the adapter shown in FIG. 14.

In another variation, shown in FIG. 14, the tool plate 129 could have a T-shaped extension with the bar plate 145 of the extension extending at an angle, preferably a right angle, to the tool plate 129, having a straight, scraping edge 147 on one side and one or more nail receiving slots 149 on the other side. The tool section 139, shown in FIG. 13, could also have a bar plate 145'. In this modification, as shown in FIG. 15, it is preferred that the bar plate 145' extend at an angle to the tool section 139 to be approximately parallel with the handle 121. In either embodiment, employing the bar plates 145, 145', the broom can be pushed/pulled to scrape in one direction with one end of the bar plate or pulled/pushed in the opposite direction to engage a nail with the other, opposite end of the bar plate.

Figure 16:
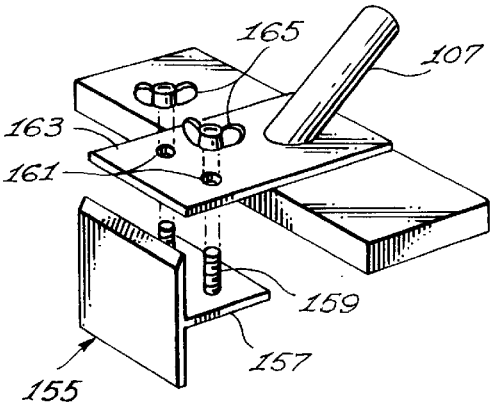
FIG. 16 is a perspective view showing an adapter, with means for detachably receiving a tool, mounted on a broom.

If desired, the tool section and the bar plate could be modified to have the tool section detachably receive the bar plate. As shown in FIG. 16 the modified bar plate 155 is constructed with a connector plate 157 that extends transversely from the center of the bar plate. A pair of bolts 159 extend transversely from the connector plate 157. These bolts 159 extend through a pair of holes 161 in the modified tool section 163. Nuts 165 cooperate with the bolts 159 to securely fasten the bar plate 155, via the connector plate 157, to the tool section 163. Other types of mounting means could be employed to detachably connect the modified bar plate to the modified tool section.

Figure 17:
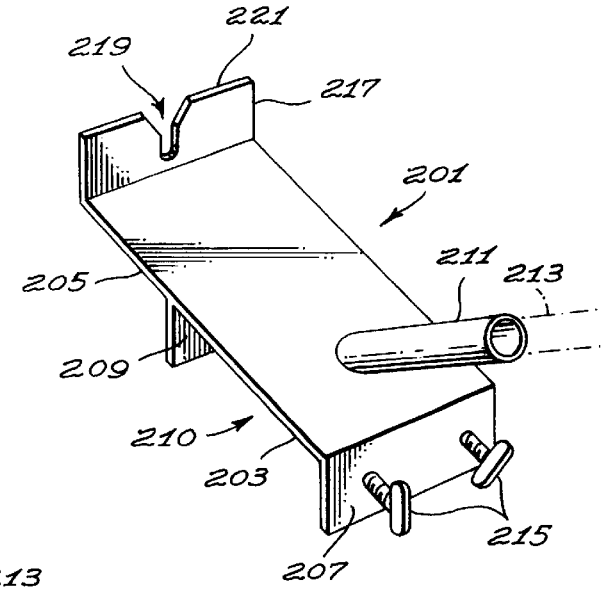
FIG. 17 is a perspective view of another embodiment of the adapter.
Figure 18:
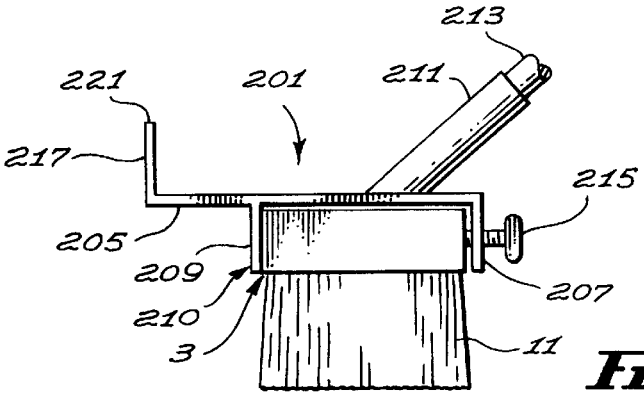
FIG. 18 is a side view showing the adapter of FIG. 17 mounted on a broom.

The adapter 101 has been shown as a flat base section with various tool extensions, the base section carrying a tubular, handle-receiving member, and connected to the top of the broom head with fasteners. The adapter could be removed by removing the fasteners. The adapter could be modified however to make it easier to attach to, or remove from, a broom. To this end, the adapter shown in FIGS. 17 and 18 is in the form of a channel section that receives the broom head. The adapter 201 has a base section 203 with a tool section 205 forming an extension of the base section. Transverse legs 207, 209 extend down from the base section 203 to form a channel member sized to fit snugly over a broom 3 as shown in FIG. 18. A tubular member 211 extends upwardly and rearwardly from the base section 203, as before, to receive a broom handle 213. Thumb screws 215 pass through the transverse leg 209 to press against the broom head when the adapter is mounted on the broom head. The thumb screws 215 are tightened to securely attach the adapter to the broom head. The thumb screws 215 make the adapter easily mounted or removed. The tool section 205 is shown as carrying a tool plate 217 with a tool in the form of a nail receiving slot 219 in its free edge 221. The tool plate 217 extends at an angle, preferably a right angle, to the tool section 205. The tool section 205 could have the same tools on it as those shown in FIGS. 10 to 12 and 14. For example, FIG. 19 shows the tool section 205 carrying a tool plate 225 at its end at an angle, preferably a right angle, to it. The tool plate 225 has a scraping edge on one side and a nail receiving slot on its other side.

If desired, the tool plate could be detachably mounted on the adapter as shown in FIGS. 20 and 21. The tool plate 231 is shown as an angle member with one flange 233 of the member having holes 235 therein for receiving bolts 237 extending up from tool section 205' on the adapter 201. The tool plate 231 is clamped onto the tool section 205' with a top clamping plate 241, the bolts 237 passing through holes 242. Wing nuts 243 on the bolts tighten the clamping plate 241. The other flange 245 of the tool plate 231 carries a tool on its edge such as a nail receiving slot 247 in its free edge 247. The broom is used as before to operate the tool.

While the tools described for use with the broom have been shown as scraping edges; nail receiving slots; or a combination of scraping fingers and nail receiving slots; other tools could be used with the broom if desired. For example, if the broom is often used to sweep water, the tool could be a squeegee to help dry the surface being cleaned.

I claim:

1. A tool adapter for use in mounting a tool on a broom, the broom having a broom head with a top, and a handle; the adapter having: a tool plate, the tool plate having a base section; means on the tool plate for use in detachably mounting the base section of the tool plate on the top of the broom head; a tubular member on the base section receiving the handle of the broom; a tool section adjacent the base section and carrying a tool at its free end spaced from the broom head when the base section is mounted on the broom head, the tool for use in working on the surface being cleaned by the broom, the tool comprising at least one nail receiving slot in the free end of the tool section, the slot extending inwardly from the free end, the slot sized to receive the shank of a nail, the slot having a mouth, the mouth of the slot being widened.

2. A tool adapter as claimed in claim 1 wherein the tool has a plurality of nail receiving slots extending inwardly from the free end of the tool section, the slots defining parallel fingers between them.

3. A tool adapter as claimed in claim 2 wherein the ends of the fingers are tapered allowing the tool to pry up adhered pieces of material.

4. A tool adapter as claimed in claim 1 wherein the free end of the tool section is tapered allowing the tool to pry up adhered pieces of material.

5. A tool adapter as claimed in claim 1 wherein the tool plate is angled with the tool section extending at an angle to the base section.

6. A tool adapter as claimed in claim 5 wherein the tool plate is mounted on the broom head to have the tool section extend in the same general, but opposite, direction as the bristles.

7. A tool adapter as claimed in claim 6 wherein the free end of the tool section is tapered allowing the tool to pry up adhered pieces of material.

8. A tool adapter as claimed in claim 7 including a plurality of nail receiving slots extending inwardly from the free end of the tool section.

9. A tool adapter as claimed in claim 6 including a plurality of nail receiving slots extending inwardly from the free end of the tool section.

* * * * *